US008919578B2

(12) United States Patent
Villalobos

(10) Patent No.: US 8,919,578 B2
(45) Date of Patent: Dec. 30, 2014

(54) SHOE CAROUSEL DEVICE

(71) Applicant: Sandra Huizar Villalobos, San Antonio, TX (US)

(72) Inventor: Sandra Huizar Villalobos, San Antonio, TX (US)

( * ) Notice: Subject to any disclaimer, the term of this patent is extended or adjusted under 35 U.S.C. 154(b) by 17 days.

(21) Appl. No.: 13/753,641

(22) Filed: Jan. 30, 2013

(65) Prior Publication Data

US 2014/0209547 A1 Jul. 31, 2014

(51) Int. Cl.

| | |
|---|---|
| ***A47F 7/08*** | (2006.01) |
| ***A47F 5/02*** | (2006.01) |
| ***A47B 49/00*** | (2006.01) |

(52) U.S. Cl.

CPC .. *A47F 7/08* (2013.01); *A47B 49/00* (2013.01)

USPC ..... 211/36; 211/144

(58) Field of Classification Search

CPC ..... A47F 7/08; A47F 5/02; A47F 3/10; A47F 5/025; A47F 5/04; A47F 5/05; A47F 5/06; A47F 3/11; A47F 3/08; A47B 61/04; A47B 49/00; A47B 49/004; A47B 49/003; A47B 13/083; A47B 13/08; A47B 95/043; A47G 25/005; A47G 25/54; E05B 69/003; A47L 23/20; A47L 23/16; B25H 3/04

USPC ..... 211/36, 196, 205, 34, 37, 144, 163, 211/129.1, 131.1, 133.4, 70, 56, 58, 1.51, 211/1.52, 180, 13.1; 108/103, 27, 139; 312/125, 135, 305; 206/278

See application file for complete search history.

(56) References Cited

U.S. PATENT DOCUMENTS

| | | | | |
|---|---|---|---|---|
| 2,973,867 | A * | 3/1961 | Cohen | 211/37 |
| 3,437,214 | A * | 4/1969 | Sainsbury | 211/90.04 |
| 3,468,039 | A * | 9/1969 | Dubbert | 434/429 |
| 3,833,128 | A * | 9/1974 | Sumner | 211/131.1 |
| 4,036,367 | A * | 7/1977 | Stambaugh et al. | 211/37 |
| 4,858,772 | A * | 8/1989 | Phillipson | 211/36 |
| 5,033,626 | A * | 7/1991 | Platti | 211/37 |
| 5,050,746 | A * | 9/1991 | Frankel | 211/34 |
| 5,785,185 | A | 7/1998 | Klebba | |
| 5,813,547 | A * | 9/1998 | Rice | 211/34 |
| 5,984,114 | A | 11/1999 | Frankel | |
| 6,086,171 | A * | 7/2000 | Ashley et al. | 312/97.1 |
| 6,464,086 | B1 * | 10/2002 | Klein et al. | 211/35 |
| 6,502,707 | B1 * | 1/2003 | Sullivan | 211/163 |
| 6,631,804 | B2 * | 10/2003 | Wong | 206/526 |
| 6,837,386 | B1 * | 1/2005 | Kent et al. | 211/153 |
| 7,523,833 | B2 | 4/2009 | Zipeto et al. | |

(Continued)

OTHER PUBLICATIONS

Kohls.com, Whitmore Metal Shoe Carousel, http://www.kohls.com/upgrade/webstore/product_page.jsp?PRODUCT%3C%3Eprd_id=845524892877277&pfx=pfx_shopcompare&cid=shopping3&mr:trackingCode=B10197D8-9234-E111-8D66-001517B188A2&mr:referralID=NA.

(Continued)

*Primary Examiner* — Jennifer E Novosad

(57) ABSTRACT

A shoe carousel device that includes a base with a top and a bottom, the base stabilizes and supports the shoe carousel device, a support stem with an end, the support stem is attached at an approximate 90 degree angle to the top of the base and extends upward and a plurality of stackable shelves with a top surfacing, the stackable shelves are circular shaped with a circumference, the stackable shelves each include a raised outer rim and a relatively thin mesh surfacing. The shoe carousel device also includes a motor and a foot pedal to rotate the shoe carousel device.

15 Claims, 3 Drawing Sheets

(56) References Cited

U.S. PATENT DOCUMENTS

| | | | | |
|---|---|---|---|---|
| 7,584,973 | B2 * | 9/2009 | Brager | 280/47.35 |
| 2002/0162815 | A1 * | 11/2002 | Wang | 211/194 |
| 2003/0230502 | A1 | 12/2003 | Siegel | |
| 2004/0200392 | A1 * | 10/2004 | Poo | 108/161 |
| 2005/0224428 | A1 * | 10/2005 | Weber | 211/36 |
| 2009/0230069 | A1 * | 9/2009 | Naden et al. | 211/144 |
| 2011/0188250 | A1 * | 8/2011 | Waldhuetter et al. | 362/249.05 |

OTHER PUBLICATIONS

Amazon.com, DAZ Patented Shoe/Sweater/ Bag Carousel, http://www.amazon.conn/DAZZ-Patented-Sweater-Carousel-Beige/dp/B002V91A16.

* cited by examiner

SHOE CAROUSEL DEVICE

TECHNICAL FIELD & BACKGROUND

Currently there are several organizers and utility racks for shoes which provide relatively quick and easy access to a shoe collection. If a shoe rack is overcrowded, it can lead to scuff marks and accumulate dust damaging the shoe collection.

The present invention generally relates to a shoe device. More specifically, the invention is a shoe carousel device.

It is an object of the invention to provide a shoe carousel device that is relatively narrower than a traditional shoe carousel device and conserves space.

It is an object of the invention to provide a shoe carousel device that can rotate and is controlled by a foot pedal.

It is an object of the invention to provide a shoe carousel device that has a top shelf with a plurality of slats to hold one or more flat bottom shoes at an angle against the top shelf.

What is really needed is a shoe carousel device that is relatively narrower than a traditional shoe carousel device and conserves space that can rotate and is controlled manually or by electrical power utilizing a foot pedal that will control a motor and lighting for the device. The shoe carousel will have a top shelf with a plurality of slats to hold one or more flat bottom shoes at an angle against the top shelf. The shoe carousel will be stackable and will include a plurality of stackable shelves in the range of 2 to 8 stackable shelves.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is utilized repeatedly. The phrase generally does not refer to the same embodiment, however, it may. The terms "comprising", "having" and "including" are synonymous, unless the context dictates otherwise.

Figure 1:
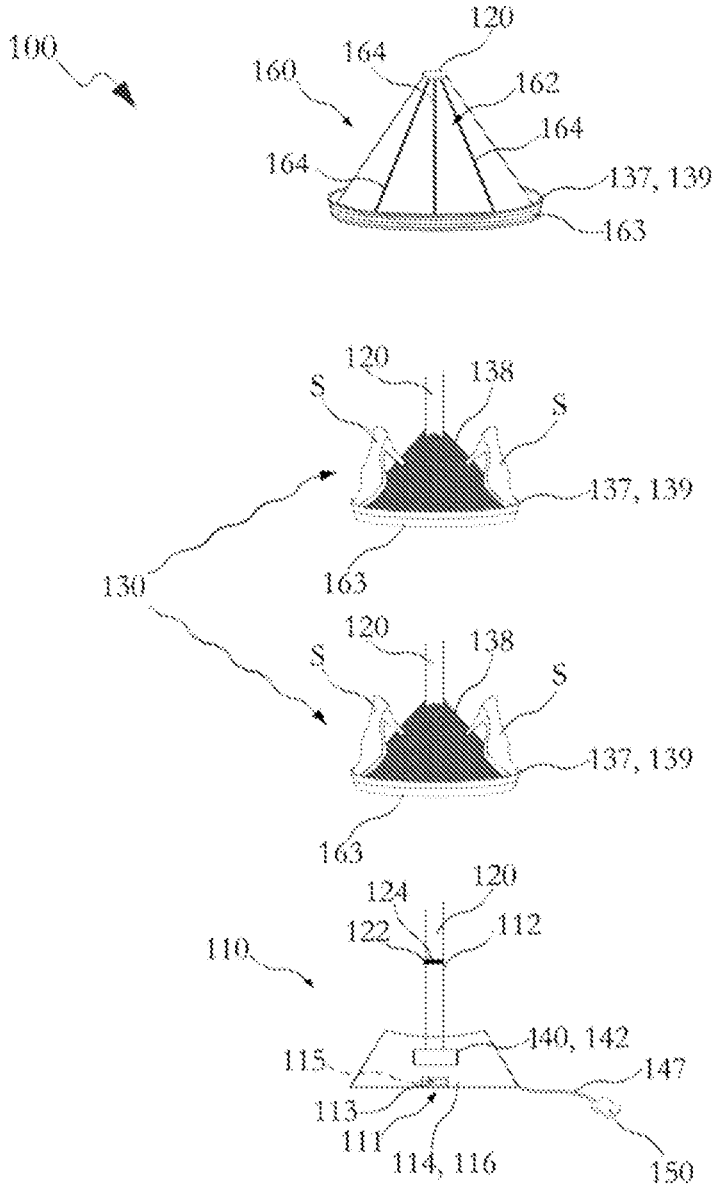
FIG. 1 illustrates a front view of a shoe carousel device, according to an embodiment of the present invention.

FIG. 1 illustrates a front view of a shoe carousel device 100, according to an embodiment of the present invention.

The shoe carousel device 100 includes a base 110, a support stem 120 and a plurality of stackable shelves 130. The base 110 has a top 112 and a bottom 114 and stabilizes and supports the shoe carousel device 100. The top 112 of the base 110 is rounded and the bottom 114 of the base 110 has a flat slip-resistant surface 116 to prevent the base 110 from sliding. The base 110 also includes a battery casing 111 with a door 113. The battery casing 111 houses one or more batteries 115 within the battery casing 111. Additional details regarding the one or more batteries 115 are illustrated and described in FIG. 3 and its description. The door 113 allows access to the one or more batteries 115 within the battery casing 111. The support stem 120 has an end 122 and is attached at an approximate 90 degree angle to the top 112 of the base 110 and extends upward. The support stem 120 is supported by a support ring 124 on the end 122 of the support stem 120. The support stem 120 is typically made of metal but can be made of any suitable material such as plastic or wood. The stackable shelves 130 include a raised outer rim 137 and a mesh surfacing 138 and are disposed on the support stem 120. Each of the stackable shelves 130 are in the range of approximately 8 inches to 9 inches apart although the stackable shelves 130 can be other suitable distances apart. The stackable shelves 130 include 2 to 8 stackable shelves 130 although there are 2 stackable shelves 130 illustrated in FIG. 1 and other suitable quantities of stackable shelves 130 can be included with the shoe carousel device 100. The raised outer rim 137 is disposed on a circumference 139 of each of the stackable shelves 130. The raised outer rim 137 is raised to facilitate keeping one or more shoes S on the stackable shelf 130 that the one or more shoes S are placed on. The raised outer rim 137 is provided with felt disposed on the raised outer rim 137 to protect and prevent the one or more shoes S on each of the stackable shelves 130 from falling off of the stackable shelves 130. The mesh surfacing 138 covers each of the stackable shelves 130 and facilitates keeping the one or more shoes S on the stackable shelves 130. The stackable shelves 130 are backward tilted at an angle in the range of approximately 220 degrees to 225 degrees to the stem 120 to facilitate keeping the one or more shoes S on the stackable shelves 130, although the stackable shelves 130 can be tilted backward at any suitable angle.

The shoe carousel device 100 also includes a motor 140 and a foot pedal 150. The motor 140 is typically an electrical powered motor 142 that rotates the shoe carousel device 100 although the motor 140 can be any suitable type of motor. The foot pedal 150 is attached to the electrically powered motor 142 by an electrical cord 147 and when depressed activates the electrically powered motor 142 to rotate the shoe carousel device 100 as well as activating the elongated rope light 163 under each of the stackable shelves 130 and the top shelf 160. Additional details regarding the motor 140 and the foot pedal 150 are illustrated in the electrical diagram in FIG. 3.

The shoe carousel device 100 has a top shelf 160 that has a top surfacing 162, a plurality of angled slats 164, a raised outer lip 137' and a circumference 139' to facilitate keeping one or more shoes S on the top shelf 160. The stackable shelves 130 and the top shelf 160 include an elongated rope light 163 disposed underneath each of the stackable shelves 130 and the top shelf 160 to provide lighting to the one or more shoes S below each of the stackable shelves 130 and the top shelf 160.

Figure 2:
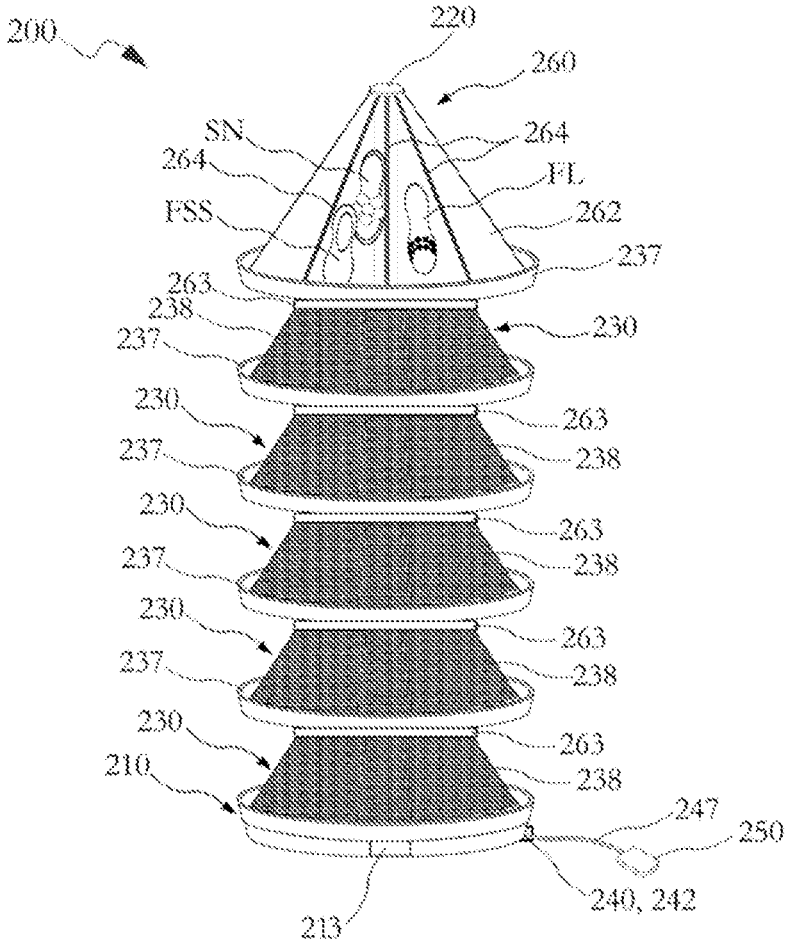
FIG. 2 illustrates a front view of a shoe carousel device, according to an embodiment of the present invention.

FIG. 2 illustrates a front view of a shoe carousel device 200, according to an embodiment of the present invention. The shoe carousel device 200 illustrated and described in FIG. 2 is a similar shoe carousel device 100 illustrated and described in FIG. 1 and its description. The shoe carousel device 200 illustrated and described in FIG. 2 also includes a base 210, a support stem 220, a plurality of stackable shelves 230, an raised outer rim 237, a battery casing with a door 213, a motor 240, an electrically powered motor 242 and a foot pedal 250 with an electric cord 247 that are similar to the base 110, the support stem 120, the plurality of stackable shelves 130, the raised outer rim 137, the battery casing 111 with a door 113, the motor 140, the electrically powered motor 142, the foot pedal 150 and the electrical cord 147 illustrated and described in FIG. 1 and its description.

Additionally FIG. 2 includes a top shelf 260 that is similar to the top shelf 160 illustrated and described in FIG. 1 and its description. The top shelf 260 has a top surfacing 262. The top shelf 260 has a plurality of angled slats 264 disposed on the top surfacing 262 of the top shelf 260. The angled slats 264 facilitate keeping one or more flat soled shoes FSS such as sandals SN, flats FL or other suitable flat soled shoes FSS on the top shelf 260. The top shelf 260 also has a mesh surfacing 238 and a raised outer lip 237 to prevent the one or more flat soled shoes FSS, sandals SN or flats FL from falling off of the top shelf 260. Each of the stackable shelves 230 and the top shelf 260 will include an elongated rope light 263 that will provide lighting to the one or more flat soled shoes FSS, sandals SN or flats FL below it.

Figure 3:
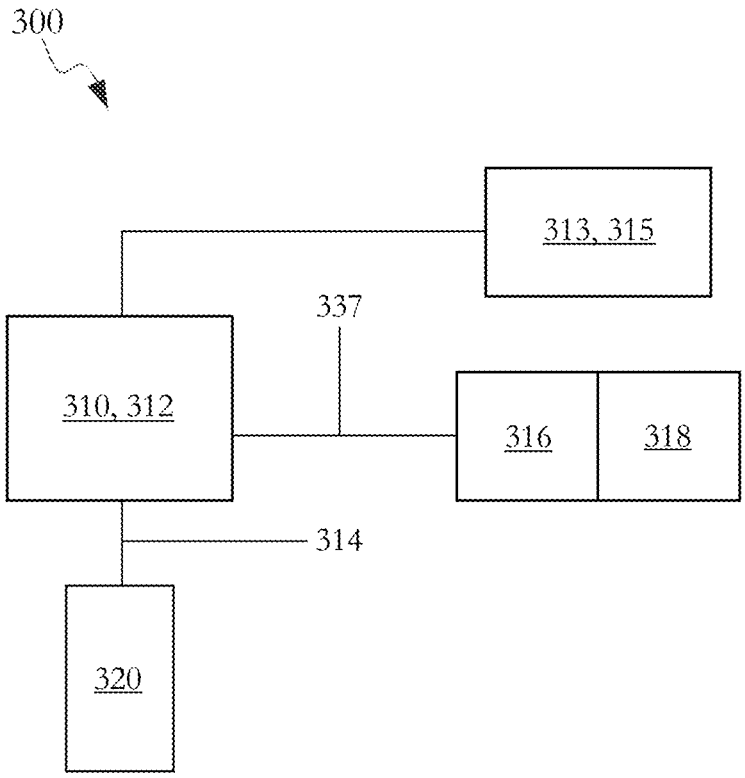
FIG. 3 illustrates an electrical diagram of a shoe carousel device, according to an embodiment of the present invention.

FIG. 3 illustrates an electrical diagram of a shoe carousel device 300, according to an embodiment of the present invention.

The shoe carousel device 300, the motor 310 and the foot pedal 320 illustrated and described in FIG. 3 and its description are similar to the shoe carousel device 100, the motor 140 and the foot pedal 150 illustrated and described in FIG. 1 and its description.

The shoe carousel device 300 also includes a motor 310 and a foot pedal 320. The motor 310 is typically an electrically powered motor 312 that rotates the shoe carousel device 300 although the motor 310 can be any suitable type of motor and also powers the elongated rope light 363 disposed beneath each of the stackable shelves 130 and the top shelf 160. The electrical powered motor 312 includes an electrical cord 337 and an electrical plug 316 that can be inserted into an electrical outlet 318. The electrical powered motor 312 can also be powered by one or more batteries 311 such as one or more alkaline batteries 313, one or more lithium batteries 315 or other suitable number and type of batteries. The foot pedal 320 is attached to the electrically powered motor 312 by an electrical cord 314 and when depressed activates the electrically powered motor 312 to rotate the shoe carousel device 300.

The shoe carousel device is a rotating stand for heels, sandals and sneakers. The shoe carousel device is made of wood and mesh, plastic and mesh or metal and mesh and may accommodate approximately two to eight levels of shoe holders or stackable shelves. A raised outer rim that matches the base of the shoe carousel device is lined with felt to prevent shoes from scuffs and from falling off of the shoe carousel device resulting in scratches on one or more shoes on the shoe carousel device. An optional motor with a foot pedal provides power to rotate the shoe carousel device hands-free. The shoe carousel device may be readily available at retailers of home goods. The shoe carousel device features a multi-layered storage center for footwear. The shoe carousel device is also designed in a variety of colors and styles.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A shoe carousel device, comprising:

a base with a top and a bottom, the base stabilizes and supports the shoe carousel device;

a support stem with an end, the support stem is attached at a 90 degree angle to the top of the base and extends upward;

a plurality of stackable shelves each with a circumference, the stackable shelves each include a raised outer rim and a mesh surfacing, the stackable shelves are disposed on the support stem;

a top shelf with a top surfacing, wherein the top shelf has a plurality of angled slats disposed on the top surfacing of the top shelf, the angled slats facilitate keeping one or more flat soled shoes on the top shelf;

an electrical powered motor disposed in said base and connected to a power source and a foot pedal, wherein said motor is operative to rotate the shoe carousel device when the foot pedal is depressed; and an elongated rope light disposed underneath each of the stackable shelves and the top shelf, wherein the elongated rope light illuminates when the foot pedal is depressed to provide lighting to the one or more shoes below each of the stackable shelves and the top shelf.

2. The shoe carousel device according to claim 1, wherein the top of the base is rounded.

3. The shoe carousel device according to claim 1, wherein the bottom of the base has a flat slip-resistant surface to prevent the base from sliding.

4. The shoe carousel device according to claim 1, wherein the support stem is supported by a support ring on the end of the support stem.

5. The shoe carousel device according to claim 1, wherein the support stem is made of a material selected from the group consisting of metal, plastic or wood.

6. The shoe carousel device according to claim 1, wherein the stackable shelves are in the range of 8 inches to 9 inches apart.

7. The shoe carousel device according to claim 1, wherein the stackable shelves include 2 to 8 stackable shelves.

8. The shoe carousel device according to claim 1, wherein the raised outer rim is on the circumference of each of the stackable shelves.

9. The shoe carousel device according to claim 1, wherein the raised outer rim is raised to facilitate keeping one or more shoes on the stackable shelves that the one or more shoes are placed on.

10. The shoe carousel device according to claim 9, wherein the raised outer rim is provided with felt to protect and prevent the one or more shoes on each of the stackable shelves from falling off of the stackable shelves.

11. The shoe carousel device according to claim 10, wherein the mesh surfacing covers each of the stackable shelves, the mesh surfacing facilitates keeping the one or more shoes on the stackable shelves from falling off of the stackable shelves.

12. The shoe carousel device according to claim 10, wherein the stackable shelves are backward tilted at an angle in the range of 220 degrees to 225 degrees to the stem to facilitate keeping the one or more shoes on the stackable shelves.

13. The shoe carousel device according to claim 1, wherein the electrical powered motor includes an electrical cord and an electrical plug.

14. The shoe carousel device according to claim 1, wherein the electrical powered motor is powered by one or more batteries.

15. The shoe carousel device according to claim 14, wherein the one or more batteries are a selected one of one or more alkaline batteries and one or more lithium batteries.

* * * * *